United States Patent [19]
Conway
[11] 4,227,620
[45] Oct. 14, 1980

[54] SPECIMEN COLLECTING TUBE

[75] Inventor: Hugh T. Conway, Cedar Grove, N.J.

[73] Assignee: Becton, Dickinson and Company, Paramus, N.J.

[21] Appl. No.: 16,156

[22] Filed: Feb. 28, 1979

[51] Int. Cl.[3] ..... B01L 3/14; B65D 39/00

[52] U.S. Cl. ..... 215/355; 128/272; 128/763; 215/DIG. 3; 422/102

[58] Field of Search ..... 422/102; 215/DIG. 3, 215/355, 31, 33; 206/828; 220/352, 354, 356, DIG. 19; 128/272, 763, 764, 765

[56] References Cited

U.S. PATENT DOCUMENTS

| | | | |
|---|---|---|---|
| 1,115,597 | 11/1914 | Sherman | 215/DIG. 3 |
| 2,106,880 | 2/1938 | Toaz | 215/355 X |
| 2,142,278 | 1/1939 | Mendelson | 215/DIG. 3 |
| 2,190,054 | 2/1940 | Cutter et al. | 215/DIG. 3 |
| 2,780,225 | 2/1957 | Barr et al. | 128/272 |
| 3,850,174 | 11/1974 | Ayres | 128/272 |

FOREIGN PATENT DOCUMENTS

| | | | |
|---|---|---|---|
| 2236528 | 1/1974 | Fed. Rep. of Germany | 215/355 |

*Primary Examiner*—Arnold Turk

[57] ABSTRACT

A specimen collection tube for liquids such as blood having an internal surface adapted to mate with the bottom of a stopper is provided. By necking in the tube wall at a point which is generally coincident with an appropriately formed taper at the stopper bottom, blood or additives will not be entrapped at the junction. Slots or other openings which may be provided along the outside of the stopper wall are sealed off from the inside of the tube by the necked in portion.

4 Claims, 5 Drawing Figures

FIG. 3
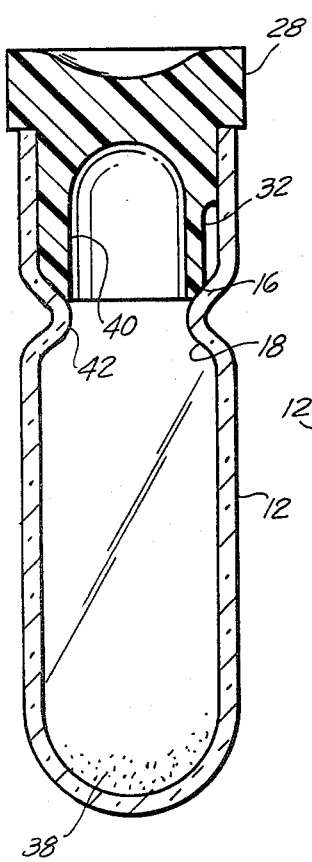
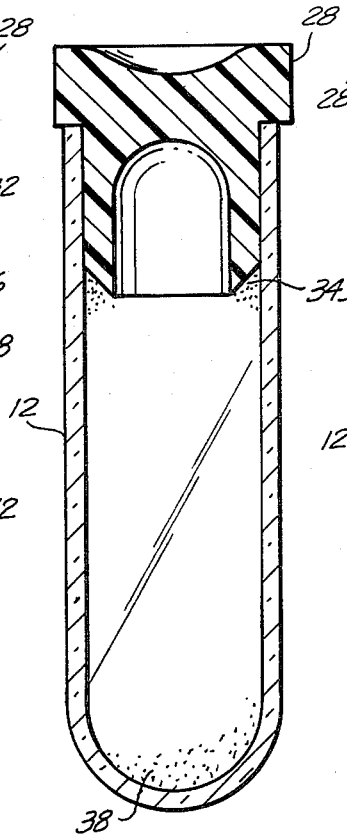
FIG. 4
PRIOR ART
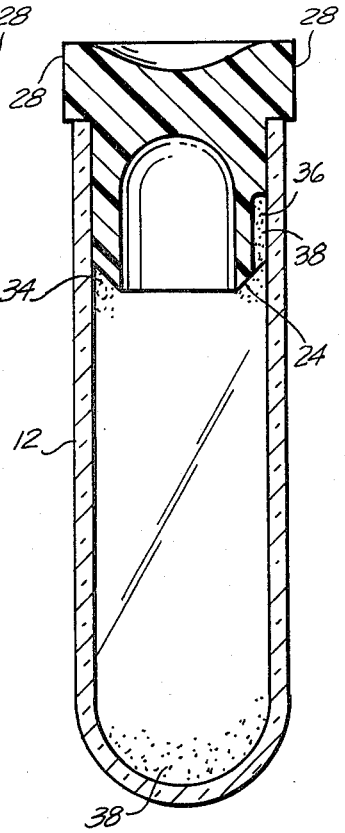
FIG. 5
PRIOR ART

SPECIMEN COLLECTING TUBE

BACKGROUND OF THE INVENTION

The field of the invention relates to specimen collection tubes and stoppers therefor.

Blood collection tubes typically have straight side walls which terminate in an open end adapted for receiving a resilient stopper. The input end of the stopper usually is tapered to facilitate its insertion within the tube. Because of the angle the taper forms with the interior walls of the tube, a crevice is created in which blood can flow and cling. Centrifuging the tube does not always remove this blood deposit. It must therefore be wiped off laboriously to avoid contaminating the specimen. Even an untapered stopper may tend to attract blood which may be difficult to spin down.

Another problem arises from the fact that some stoppers contain slots along the outside surfaces of their side walls to serve as vent ports aiding evacuation. The slot can be a problem if additives are to be included within the tube as such additives may be entrapped therein during storage and handling. Blood deposits may also be retained in the slot.

SUMMARY OF THE INVENTION

It is an object of the invention to provide a specimen collecting tube which is designed to reduce the possibility of blood or other deposits from forming at the stopper/tube junction.

It is another object of the invention to minimize difficulties associated with the inclusion of additives in tubes with slotted stoppers.

Still another object of the invention is to increase the vacuum seal area thereby lengthening shelf life.

A still further object of the invention is to reduce the need for special stopper coatings with their associated expense.

With these among other objectives in mind, a specimen collection tube is provided having a tube wall shaped to conform to and have a smooth transition with the bottom surface of a stopper. The tube includes a necked-in annular portion and a corresponding inwardly protruding interior wall which allows the substantially flush fit of a stopper. If a bottom tapered stopper is to be utilized, the inwardly protruding wall angles downwardly such that the taper rests smoothly thereon. Accordingly there is no crevice in which significant blood deposits can be retained. Any slot provided within the stopper will be positioned above the necked-in portion, and subsequently blocked from contact with the internal volume. Neither additives nor specimen would accumulate therein.

BRIEF DESCRIPTION OF THE DRAWINGS

FIG. 3 is a sectional view of the collection tube having a slotted stopper inserted therein;

FIG. 4 is a sectional view of a prior art collection tube and stopper;

FIG. 5 is a sectional view of a prior art collection tube having a slotted stopper inserted therein.

DESCRIPTION OF THE INVENTION

Figure 1:
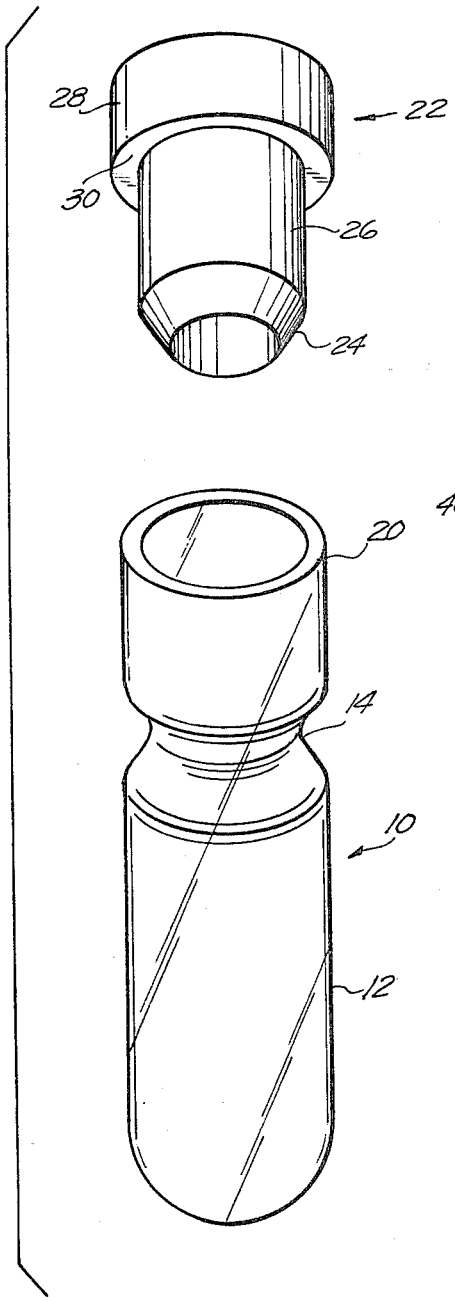
FIG. 1 is a perspective view of a specimen collection tube according to the invention and a stopper adapted for sealing the tube.
Figure 2:
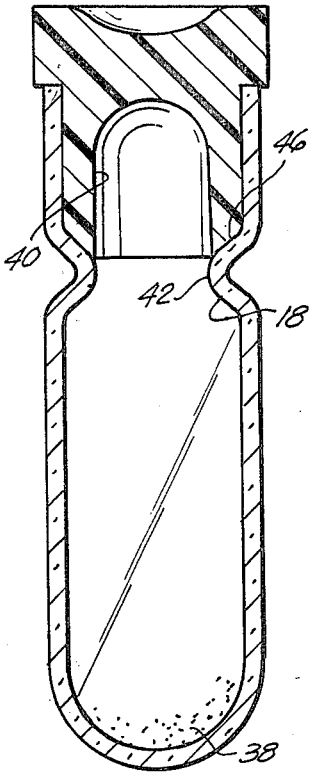
FIG. 2 is a sectional view of the collection tube with the stopper inserted therein.

FIGS. 1–3 are illustrative of the invention and its advantageous features. A specimen collection tube 10 is provided having generally cylindrical side walls 12 with the exception of a circumferential necked-in portion 14. The necked-in portion is characterized by a corresponding inner protrusion of the interior wall of the tube. In the illustrated embodiment, the protrusion is symmetrical such that the upper half 16 is angled downwardly and the lower half 18 angled upwardly. The upper end 20 of the tube is open to permit the insertion of a resilient stopper 22. Blow molding or other manufacturing methods can be used in producing the tube.

The stopper 22 is usually molded from rubber and the tube from glass, but other materials such as cork and plastic may alternatively be employed. To facilitate insertion within the tube, an inwardly tapering bottom section 24 is provided. Above the taper, the neck 26 is cylindrical to conform to the shape of the tube. The top 28 of the stopper is enlarged with respect to the neck, and its lower edge 30 may rest on the upper rim of the tube. As shown in FIG. 3, the neck of the stopper may include a slot 32 such as a vent port to aid in evacuation of the tube.

FIGS. 4 and 5 show prior art stopper/tube assemblies, the same numerals being used to designate similar features as described above. The tube side walls 12 are straight and the bottom of the stopper is tapered. This creates a crevice 34 in which blood can collect in a undesirable manner. If the stopper is slotted as in FIG. 5, a volume 36 is created between the stopper and tube wall in which additives 38 or blood within the tube can become entrapped.

These problems are avoided by the invention since the spaces between the stopper and tube wall which would tend to retain blood or additives are minimized. In the embodiment shown in FIG. 2, the tapered bottom of the stopper is substantially flush with the upper half of the inwardly protruding wall. There is a smooth transition between the bottom of the stopper and the tube wall. Also, the inner surface 40 of the neck is substantially tangent to the apex 42 of the inner protrusion.

In the example shown in FIG. 3, the tube and stopper are of the same design as FIG. 2 with the exception of the slot 32. The slot is sealed off from the remainder of the tube by the inwardly protruding wall. Additives or blood are thereby precluded from collecting there.

It will be appreciated by those skilled in the art that modifications can be made in the above-described structure without departing from the spirit of the invention. For example, the internal surface 40 may not be tangent to the apex of the protrusion. In addition, the stopper and protrusion need not mate along their entire interface so long as a smooth transition is provided between the stopper and tube walls without formation of spaces in which blood may be entrapped. The description and drawings are intended to be illustrative rather than limiting, and the scope of the invention is to be determined by reference to the appended claims.

What is claimed is:

1. A specimen collection receptacle for liquids such as blood comprising: a tubular body having a closed end and an open end and a circumferential protruding portion extending interiorly from the tubular body between said closed and open ends, said protruding portion being formed by a necked-in part of the tubular body so that the interiorly protruding portion has a surface facing the open end angled toward the closed end; and a stopper sealing the open end of the tubular body, said stopper having a tapered bottom resting upon the protruding surface such that a smooth transition is formed between the exterior surface of said stopper and the interior surface of the tubular body.

2. A specimen collection receptacle as described in claim 1 wherein said stopper bottom is adapted to rest substantially flush upon said protruding surface.

3. A specimen collection receptacle as described in claim 2 wherein said stopper includes an exteriorly slotted neck adapted for insertion within the tube, the protruding surface of the tubular body capable of sealing off said slot from the interior of said body.

4. A specimen collection receptacle as described in claims 1, 2 or 3 wherein said tubular body has a rim defining its open end, said stopper comprises a top portion, a neck, and the tapered bottom, the neck adapted for insertion within the open end and to bear against the interior surface of the tubular body, the top portion having a larger diameter than said neck and including a lower edge adapted for resting upon said rim.

* * * * *